US005911544A

United States Patent [19]

Mahony

[11] Patent Number: 5,911,544

[45] Date of Patent: Jun. 15, 1999

[54] SOIL COMPACTOR

[76] Inventor: George K. Mahony, 1809 King Edward Dr., Kissimmee, Fla. 37444

[21] Appl. No.: 08/923,779

[22] Filed: Sep. 4, 1997

Related U.S. Application Data

[60] Provisional application No. 60/024,691, Sep. 5, 1996.

[51] Int. Cl.[6] ..... F02D 3/046

[52] U.S. Cl. ..... 405/271; 405/179

[58] Field of Search ..... 405/154, 157, 405/159, 179, 180; 172/247, 253; 37/142.5

[56] References Cited

U.S. PATENT DOCUMENTS 2,876,717 3/1959 Tetyak ..... 405/154
3,534,669 10/1970 Judd ..... 415/154
3,807,067 4/1974 Cloud ..... 37/142.5
4,539,765 9/1985 Reece ..... 405/179

*Primary Examiner*—Tamara L. Graysay
*Assistant Examiner*—Frederick L. Lagman

[57] ABSTRACT

Backfill soil is compacted under the haunches of and up to the spring line of a pipe laid in a trench by tamping the soil in two directions with two pairs of hydraulically-operated ram plates extending from an elongate frame which is supported and moved by wheels along the pipe. The first pair of ram plates, located near the bottom half of the pipe, compact the soil under the haunch of the pipe by compacting the soil at an angle such as 45° (from vertical) from either side of the pipe towards the centerline of the pipe. The second pair of ram plates, located behind the machine and above the spring line of the pipe, compacts the soil in a downward (vertical) direction on either side of the pipe.

3 Claims, 3 Drawing Sheets

SOIL COMPACTOR

RELATED CASES

This is a continuation-in-part of commonly-owned, copending U.S. Provisional Patent Application No. 60/024,691 filed Sep. 5, 1996, incorporated by reference herein.

BACKGROUND

The present invention relates to soil (or sand) compacting machines and, more particularly, to machines for compacting soil in trenches around and under pipes, such as sewer pipes and water mains.

Trenches are frequently dug in roadways in conjunction with pipe installations. Then the pipe is laid in the trench. As fill material (soil or sand) is subsequently replaced into the trench, it must somehow be compacted around and under the pipe. Present soil compacting machines fail to compact the soil under the pipe "haunches" and up to the "spring line" of the pipe. The "spring line" is the a hypothetical centerline of the pipe, above which is the top portion of the pipe, below which is the bottom portion of the pipe. The "haunch" is a portion of the bottom portion of the pipe, below the spring line.

Construction codes often require that the soil or sand surrounding a pipe meet soil compacting specifications of 95% Proctor. The term "Proctor" refers to the density of the soil or sand from a particular sample. If the soil is inadequately compacted under the haunches of the pipe, rising water tables are likely to cause soil runoff under the haunch of the pipe which, in turn, causes both the pipe and the street above the pipe to settle and, in some cases, causes the pipe to break. This creates an undesirable sinkhole in the street which is extremely costly to repair, and a very dangerous condition to the public. Failures of this type have been know to cause entire sections of roadway to collapse.

In the past, soil around pipes has been compacted primarily through the use of jack hammers (with ram plate ends attached thereto), or the like. Such "manual" techniques are not only time consuming and expensive, the results obtained thereby are often marginal, at best. The jackhammer operator must stand astride the pipe, between the pipe and the trench wall. In the event that the trench wall caves in, the operator can be crushed between the trench wall and the pipe.

U.S. Pat. No. 3,814,533, incorporated by reference herein, discloses a soil compactor which uses eccentric weights to compact the soil. The compactor of this patent is useful for compacting small areas of soil in a downward, vertical direction.

U.S. Pat. No. 3,737,244, incorporated by reference herein, discloses a soil compactor which is pulled by a tractor or the like, which is useful for compacting soil in a downward, vertical direction.

The prior art is lacking in teachings directed to compacting soil under the haunches of pipes in trenches.

DISCLOSURE OF THE INVENTION

It is therefore an object of the present invention to provide an improved technique for compacting soil under the haunches and up to the spring line of pipes, such as sewer pipes or water mains, particularly when those pipes are laid in trenches under roadways.

It is a further object of the present invention to provide a soil compactor that compacts soil or sand under the haunches of a sewer pipe and up to the "spring line" of the pipe.

It is a further object of the invention to provide a soil compactor that compacts soil to meet soil compacting specifications of 95% to 100% Proctor, thereby minimizing soil runoff under the haunches of the pipe and consequent undesirable settling of the pipe itself or of a roadway overlying the pipe, including avoiding pipes breaking or shearing due to settling.

It is a further object of the invention to provide a soil compactor that can easily be operated by one person, and that substantially avoids the problem of the operator being crushed between the trench wall and the sewer pipe in the event that the banks of the trench wall cave in.

According to the invention, a soil compactor has an elongate frame supported and driven by wheels which are arranged so that the frame can ride along a sewer pipe, hugging the upper circumferential portion of the pipe. A push plate is provided at the front of the elongate frame, and shapes backfill which is placed in front of the soil compactors.

To achieve maximum compaction, two pairs of lever arms are arranged symmetrically on either side of the centerline of the elongate frame (and of the pipe upon which the compactor rides) and support respective two pairs of ram plates which compact the soil in respective two directions.

The first pair of ram plates located near the bottom half of the pipe compact the soil under the haunch of the pipe by compacting (tamping) the soil at an angle such as 45° (from vertical) from either side of the pipe towards the centerline of the pipe.

The second pair of ram plates located behind the machine and above the spring line of the pipe, compacts the soil in a downward (vertical) direction on either side of the pipe to 100% Proctor.

The ram plates are operated in any suitable manner, such as hydraulically (i.e., using hydraulic pistons, hydraulic lines, and a supply of pressurized hydraulic fluid such as hydraulic oil. The ram plates may also be operated purely mechanically, such as with a chain driving an eccentric shaft.

BRIEF DESCRIPTION OF THE DRAWINGS

Reference will now be made in detail to preferred embodiments of the invention, examples of which are illustrated in the accompanying drawings. Although the invention will be described in the context of these preferred embodiments, it should be understood that it is not intended to limit the spirit and scope of the invention to these particular embodiments. In the figures presented herein, the size of certain elements are often exaggerated (not to scale, vis-a-vis other elements in the figure), or simplified, for illustrative clarity.

DETAILED DESCRIPTION OF THE INVENTION

Figure 1:
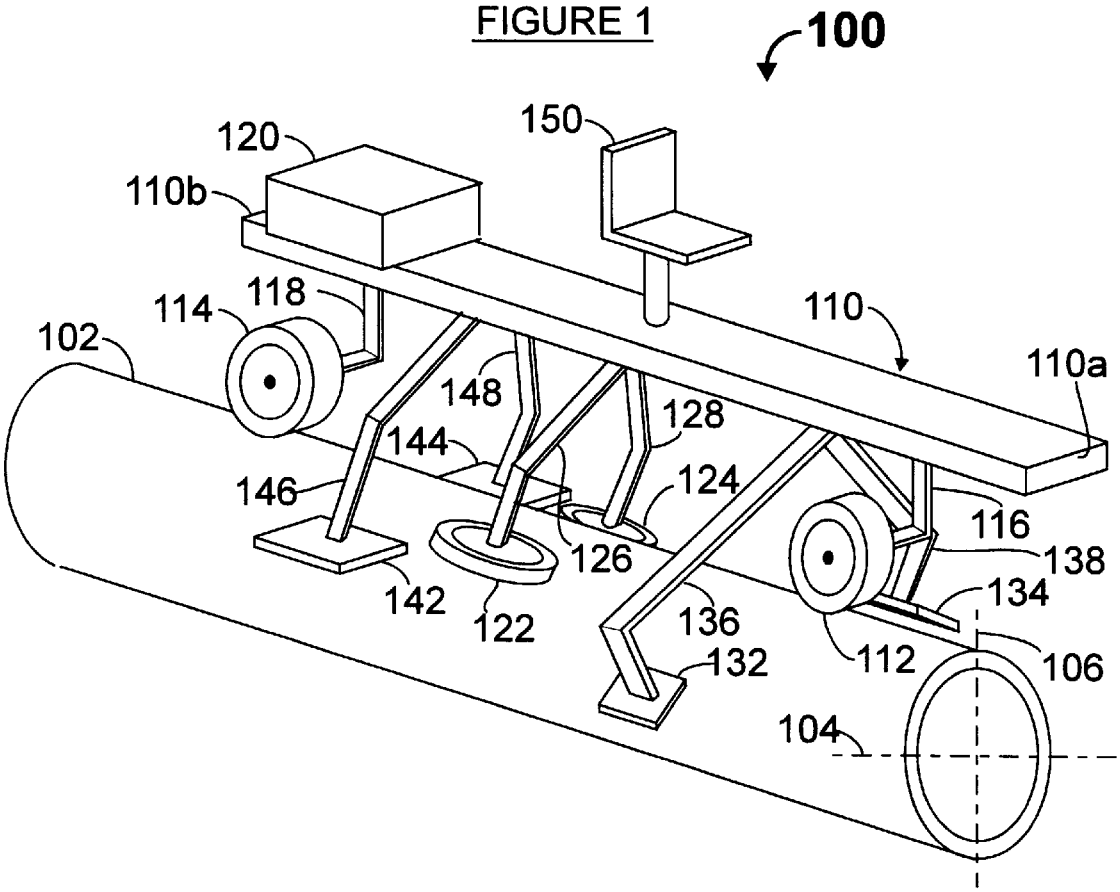
FIG. 1 is a perspective, diagrammatic view of the soil compactor of the invention.

FIG. 1 shows the soil compactor 100 of the invention. As illustrated, in use, the soil compactor 100 "rides" along a pipe 102 which may be a sewer pipe. The invention is useful for a pipe 102 which is disposed at the bottom of a trench (not shown) which may have been excavated under a roadway (not shown) . After the pipe is laid in the trench, it is covered with soil which, as mentioned above, should be compacted. As mentioned above, it can be critical to compact the soil under the spring line 104 of the pipe 102, particularly in the haunch area.

The compactor 100 of the present invention is particularly useful for compacting soil around pipes (102) having a diameter of at least one foot (twelve inches) to as much as ten feet in diameter.

The compactor 100 has a main frame element 110 which supports all of the other elements of the compactor. The frame element 110 is suitable formed as a truss, is elongate, has a front (forward) end 110*a* and a rear (aft) end 110*b*.

Wheels (tires) 112 and 114 are disposed at the ends of arms 116 and 118, respectively from the frame 110 so that the wheels 112 and 114 are underneath the frame. Typically, there are two wheels, one wheel 112 near the forward end 110*a* of the frame 110 and one wheel 114 near the aft end 110*b* of the frame 110. These two wheels 112 and 114 are preferably disposed along a longitudinal centerline of the frame 110, which is coincident with the vertical centerline 106 of the pipe. A suitable mechanical power source, such as a gasoline or diesel powered engine 120 is provided, and is disposed on the frame 110, such as at the aft end 110*b* thereof, to provide motive power, through a drive train (not shown) to at least one of the wheels 112 and 114. The drive train would include drive shafts, gearboxes, chains, and the like, all of which would be well known to those having ordinary skill in the art to which this invention most nearly pertains, in light of the description set forth herein.

The two wheels 112 and 114 support the compactor 100 atop the pipe 102, and convey the compactor 100 along the pipe 102.

Two guide wheels 122 and 124 are also preferably provided, each of which are at the ends of arms 126 and 128, respectively, which extend from the frame 110 so that the wheels 122 and 124 are underneath the frame and contact the pipe 102 on either side of the vertical centerline 106, preferably at or above the spring line 102. These two arms 126 and 128 extend from a midportion of the frame 110, between the two arms 116 and 118, so that the two wheels 122 and 124 are disposed approximately halfway (longitudinally) between the two wheels 112 and 114. These two wheels 122 and 124 need not be driven (by the power source 120). They may be freewheeling, and help maintain the compactor 100 "balanced" and centered atop the pipe.

Figure 2:
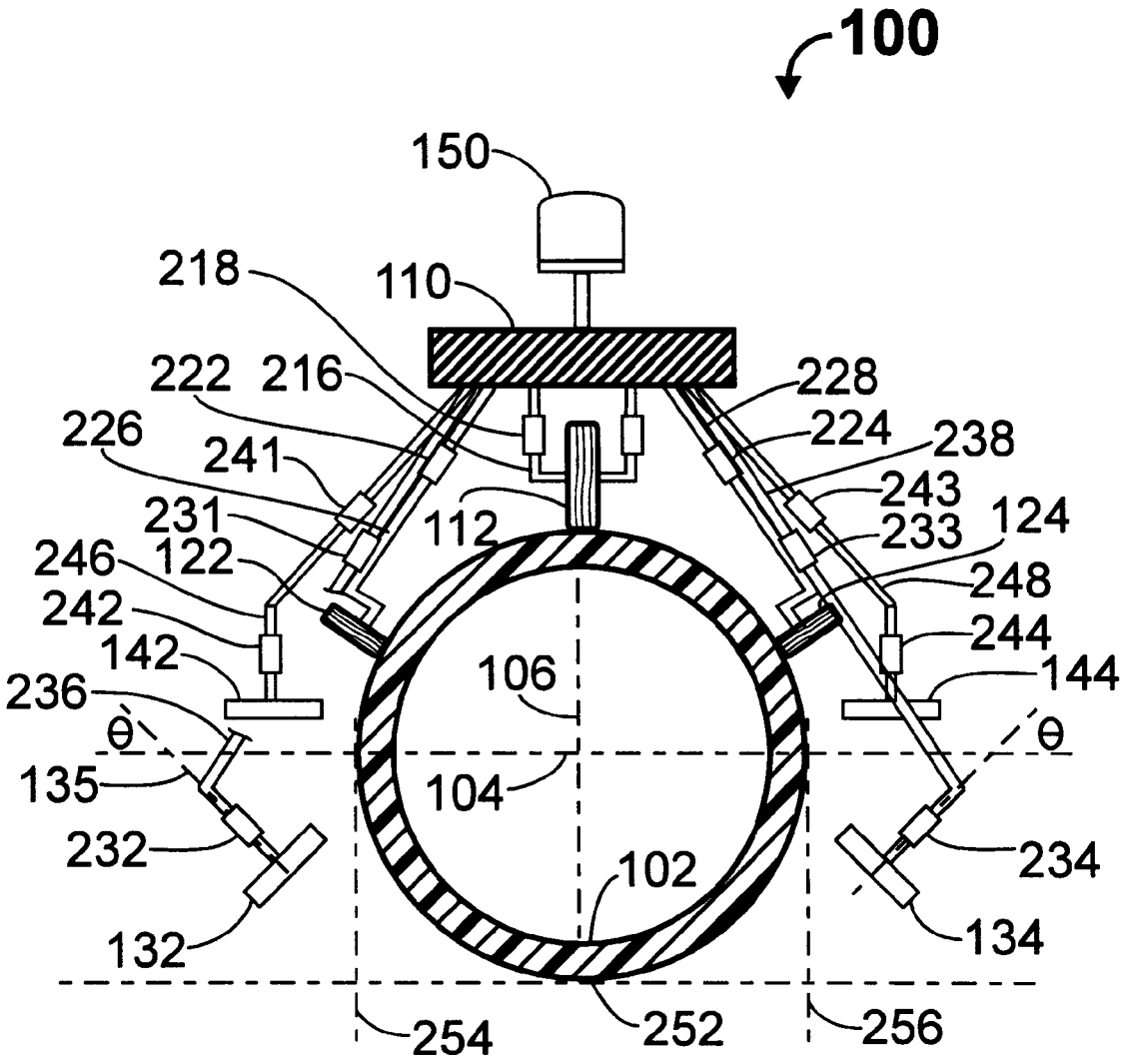
FIG. 2 is an end view of the soil compactor of FIG. 1.

As best viewed in FIG. 2, the wheel 112 is preferably supported on a two-legged arm ("fork") 216 (compare 116) which has at least one suspension element 218 such as a shock absorber and a spring incorporated therein so that when the compactor traverses irregularities (not shown) in the exterior surface of the pipe, such as a bell flange (not shown) at the junction of one pipe with another pipe, the compactor 100 traverses smoothly over the irregularity. The rear wheel 114 is not visible in the view of FIG. 2, but would preferably similarly be suspended from the frame element 110. Such a suspension for a wheel, whether it be a driving wheel or a driven wheel, would be well known to those having ordinary skill in the art to which this invention most nearly pertains, in light of the description set forth herein.

As best viewed in FIG. 2, the wheels 122 and 124 are disposed at the ends of adjustable elongate arms 226 (compare 126) and 228 (compare 128), respectively. These arms 226 and 228 are each provided with a suitable mechanism 222 and 224 for adjusting the length of the respective arm 226 and 228, thus the position that the wheels 122 and 124 ride along the external surface of the pipe 102. The length-adjustment mechanisms 222 and 224 may be as simple as bolts (not shown) through holes in overlapping ends of two-part or telescoping arms, permitting the overall lengths of the arms 226 and 228 to be shortened or lengthened. Such mechanisms for adjusting the lengths and, if necessary, the angles of mechanical arms would be well known to those having ordinary skill in the art to which this invention most nearly pertains, in light of the description set forth herein.

Compacting

In use, the compactor 100 rides (creeps) along the pipe 102. Fill material (e.g., soil or sand, not shown) is dumped into the trench. It is a principal purpose of the compactor 100 of the present invention to compact the fill around the pipe, particularly around the haunch of the pipe, up to the spring line 104 of the pipe 102. After having compacted soil around the haunch and up to the spring line 104 of the pipe 102, using the compactor 100, additional fill material may be dumped into the trench and compacted using other instrumentalities exerting a force vertically downward on the fill material, such as a steamroller or the like.

FIG. 1 shows a first pair of rams 132 and 134 disposed at the ends of arms 136 and 138, respectively, which extend from the frame 110. The rams 132 and 134 are suitably flat, preferably heavy, plates. For example, twelve inches by twelve inches by one inch thick steel plates. The arms 136 and 138 extend from a midportion of the frame 110, forward of the guide wheels 122 and 124 and just aft of the front wheel 112.

As best viewed in FIG. 2, the ram plates 132 and 134 are disposed at the ends of the respective arms 236 (compare 136) and 238 (compare 138) so as to be (i) below the spring line 104 of the pipe 102 upon which the compactor rides, and (ii) inclined at an angle such as 45° (forty five degrees), as illustrated by the dashed line 135 bisecting the 90° (ninety degree) angle formed by the lines 104 and 106. In this manner, when the rams 132 and 134 are urged back and forth, at an angle along the line 135, they will compact fill into the haunch area of the pipe 102, their flat surfaces "pounding" the fill material into the haunch area. Such a pounding motion is imparted to the rams 132 and 136 by any suitable means, such as hydraulic pistons 232 and 234, respectively. The operation of such hydraulic instrumentalities to impart motion to a reciprocating weight would be well known to those having ordinary skill in the art to which this invention most nearly pertains, in light of the description set forth herein.

In a manner similar to the manner in which the wheels 122 and 124 are disposed at the ends of "adjustable" elongate arms 226 and 228, the rams 132 and 134 are disposed at the end of "adjustable" elongate arms 236 and 238. The arms 236 and 238 are each provided with a suitable "adjustment" mechanism 231 and 233, respectively, for adjusting the length of the respective arm 236 and 238, thus the location and orientation of the rams 132 and 134 relative to the pipe 102. The length-adjustment mechanisms 231 and 233 (compare 222 and 224) may be as simple as bolts (not shown) through holes in overlapping ends of two-part or telescoping arms, permitting the overall lengths of the arms 236 and 238 to be shortened or lengthened. Such mechanisms for adjusting the lengths and, if necessary, the angles of mechanical arms would be well known to those having ordinary skill in the art to which this invention most nearly pertains, in light of the description set forth herein.

FIG. 1 shows a second pair of rams 142 and 144 disposed at the ends of arms 146 and 148, respectively, which extend from the frame 110. The rams 142 and 144 are suitably flat, preferably heavy, plates. Compare the rams 132 and 134. For example, twelve to twenty-four inches by twelve inches by one inch thick steel plates. The arms 146 and 148 extend from a midportion of the frame 110, aft of the guide wheels 122 and 124 and just forward of the rear wheel 112.

As best viewed in FIG. 2, the ram plates 142 and 144 are disposed at the ends of the respective arms 246 (compare 236) and 248 (compare 238) so as to be (i) above the spring line 104 of the pipe 102 upon which the compactor rides, and (ii) inclined so that their flat surface is substantially in a horizontal plane. In this manner, when the rams 142 and 144 are urged back and forth, vertically, they will compact fill adjacent to the haunch area of the pipe 102, their flat surfaces "pounding" the fill material vertically up to the spring line 104 of the pipe 102. Such a pounding motion is imparted to the rams 142 and 146 by any suitable means, such as hydraulic pistons 242 and 244, respectively. The operation of such hydraulic instrumentalities to impart motion to a reciprocating weight would be well known to those having ordinary skill in the art to which this invention most nearly pertains, in light of the description set forth herein.

In a manner similar to the manner in which the wheels 122 and 124 are disposed at the ends of "adjustable" elongate arms 226 and 228, the rams 142 and 144 are disposed at the end of "adjustable" elongate arms 246 and 248. The arms 246 and 248 are each provided with a suitable "adjustment" mechanism 241 and 243, respectively, for adjusting the length of the respective arm 246 and 248, thus the location and orientation of the rams 142 and 144 relative to the pipe 102. The length-adjustment mechanisms 241 and 243 (compare 222 and 224) may be as simple as bolts (not shown) through holes in overlapping ends of two-part or telescoping arms, permitting the overall lengths of the arms 246 and 248 to be shortened or lengthened. Such mechanisms for adjusting the lengths and, if necessary, the angles of mechanical arms would be well known to those having ordinary skill in the art to which this invention most nearly pertains, in light of the description set forth herein.

The compactor may be operated by remote control, or an operator may sit on a seat 150 disposed on the frame 110 and control the operation of the compactor 100 with suitable controls (not shown), such as levers, for the hydraulic and mechanical parts of the compactor. Such controls would be well known to those having ordinary skill in the art to which this invention most nearly pertains, in light of the description set forth herein.

As illustrated in FIG. 2, a horizontal line 252 is tangent to the bottom of the pipe 102. This line 252 corresponds to the bottom of a trench which the pipe is in. Two vertical lines 254 and 256 are also shown. These two vertical lines 254 and 256 are tangent to the sides of the pipe, and the distance between these two lines 254 and 256 corresponds to the diameter of the pipe which is within these two lines 254 and 256. As best viewed in FIG. 2, the rams 132, 134, 142 and 144 are all outside the two lines 254 and 256.

Scraping and Shaping

As mentioned above, fill material is dumped into the trench and is compacted (by the rams 132, 134, 142, 144) into the haunch area and up to the spring line of the pipe. To this end, an appropriate amount of fill material is dumped into the trench ahead of the compactor 100, the front rams 132 and 134 compact at an angle into the haunch area, additional fill material may be dumped into the trench aft of the front rams 132 and 134, and the rear rams 142 and 144 compact the additional fill material in a downward direction up to the spring line of the pipe.

Figure 3A:
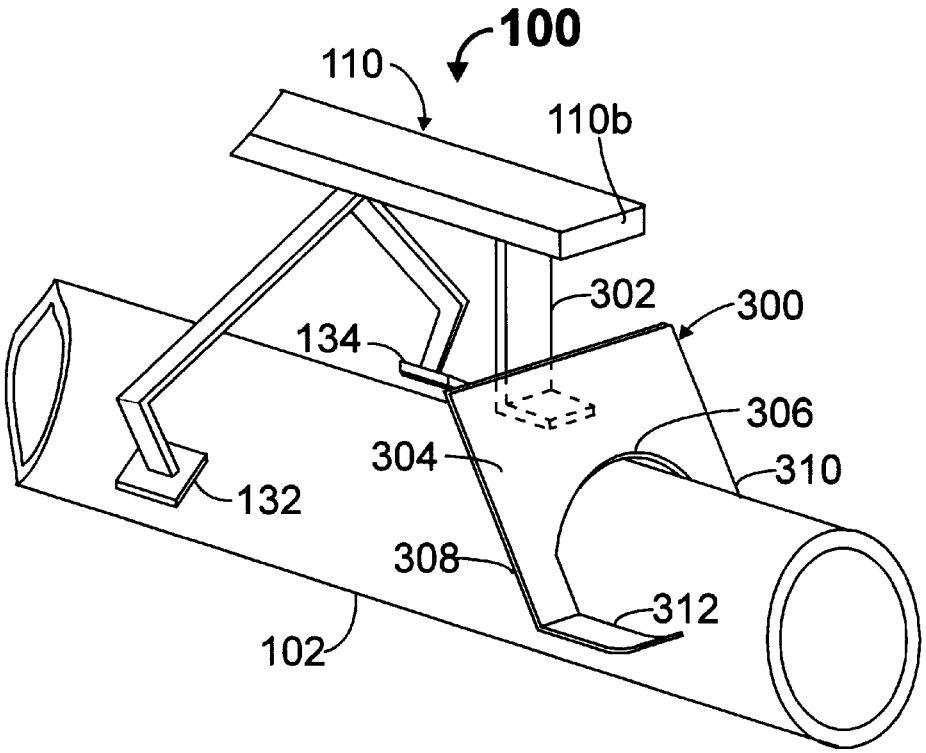
FIG. 3A is a perspective, diagrammatic view, similar to FIG. 1, showing an additional element of the soil compactor of the invention.

FIG. 3A illustrates a front scraper/shaper element 300 which is disposed on the front portion of the frame 110, forward of the angled rams 132 and 134. In use, the forward scraper element 300 serves to prepare fill material which is dumped into the trench for compacting by the two forward rams 132 and 134. The forward scraper element 300 is disposed at the end of an arm 302 extending from the frame 110 forward of the rams 132 and 134, and may be either forward of or aft of the front wheel (112, not shown in this figure). The arm 302 can be articulated to allow for vertical adjustment of the position of the forward scraper 300, and can have suspension elements, all of which would be well known to those having ordinary skill in the art to which this invention most nearly pertains, in light of the description set forth herein.

The forward scraper 300 is formed, as follows. The scraper 300 has a substantially flat planar portion 304 which is generally rectangular, having a width which is greater than the diameter of the pipe 102. An approximately semicircular cutout 306 is formed in the lower (as viewed) edge of the planar portion 304. This leaves the planar portion 304 with a left (as viewed) portion of its lower edge and a right (as viewed) portion of its lower edge. Another generally rectangular planar portion 308 extends contiguously from the left portion of the bottom edge of the planar portion 304 on one side of the pipe 102, and has a width which is at least as great as the amount that the ram 132 extends from the side of the pipe 102. Another generally rectangular planar portion 310 extends contiguously from the right portion of the bottom edge of the planar portion 304 on one side of the pipe 102, and has a width which is at least as great as the amount that the ram 134 extends from the side of the pipe 102. The planar portions 304, 308 and 310 are all coplanar, and are inclined slightly, such as 30° (thirty degrees) from vertical backwards towards the aft end of the frame element 110. A ski-like element 312 extends from the lower edge of the planar portion 308 in a direction which is towards the front 110*b* of the frame element, lies in substantially a horizontal plane, has a width which is substantially the same as the width of the planar portion 308, and is preferably integrally formed with the planar portion 308. Another ski-like element (not visible in the figure) extends from the lower edge of the planar portion 310 in a direction which is towards the front 110*b* of the frame element, lies in substantially a horizontal plane, has a width which is substantially the same as the width of the planar portion 310, and is preferably integrally formed with the planar portion 310. The horizontal plane that the ski-like elements are disposed in no higher than the spring line (104) of the pipe 102, preferably one-half the height of the spring line. In this manner, fill material is "pre-leveled" to approximately one-half the height of the spring line (104), or lower, so that the rams 132 and 134 can compact the fill material into the haunch area of the pipe 102.

Figure 3B:
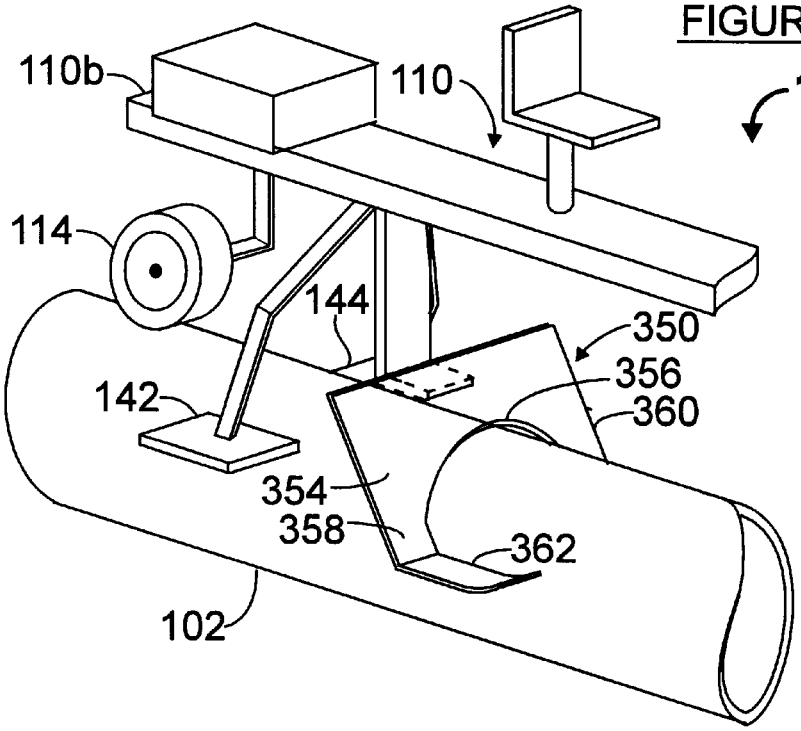
FIG. 3B is a perspective, diagrammatic view, similar to FIG. 1, showing an additional element of the soil compactor of the invention.

FIG. 3B illustrates an aft (rear) scraper/shaper element 350 (compare 300) which is disposed on an aft portion of the frame 110, forward of the vertical rams 142 and 144. In use, the aft scraper element 350 serves to prepare fill material which is dumped into the trench for compacting by the two rear rams 142 and 144. The aft scraper element 350 is disposed at the end of an arm 352 (compare 302) extending from the frame 110 forward of the rams 142 and 144, and may be either forward of or aft of the guide wheels (122 and 124, not shown in this figure). The arm 352 can be articulated to allow for vertical adjustment of the position of the aft scraper 350, and can have suspension elements, all of which would be well known to those having ordinary skill in the art to which this invention most nearly pertains, in light of the description set forth herein.

The aft scraper 350 is formed, as follows. The scraper 350 has a substantially flat planar portion 354 (compare 304) which is generally rectangular, having a width which is greater than the diameter of the pipe 102. An approximately semicircular cutout 356 (compare 306) is formed in the lower (as viewed) edge of the planar portion 354. This leaves the planar portion 354 with a left (as viewed) portion of its lower edge and a right (as viewed) portion of its lower edge. Another generally rectangular planar portion 358 (compare 308) extends contiguously from the left portion of the bottom edge of the planar portion 354 on one side of the pipe 102, and has a width which is at least as great as the amount that the ram 142 extends from the side of the pipe 102. Another generally rectangular planar portion 360 (compare 310) extends contiguously from the right portion of the bottom edge of the planar portion 354 on one side of the pipe 102, and has a width which is at least as great as the amount that the ram 144 extends from the side of the pipe 102. The planar portions 354, 358 and 360 are all coplanar, and are inclined slightly, such as 30° (thirty degrees) from vertical backwards towards the aft end of the frame element 110. A ski-like element 362 (compare 312)extends from the lower edge of the planar portion 358 in a direction which is towards the front 110*b* of the frame element, lies in substantially a horizontal plane, has a width which is substantially the same as the width of the planar portion 358, and is preferably integrally formed with the planar portion 358. Another ski-like element (not visible in the figure) extends from the lower edge of the planar portion 360 in a direction which is towards the front 110*b* of the frame element, lies in substantially a horizontal plane, has a width which is substantially the same as the width of the planar portion 310, and is preferably integrally formed with the planar portion 310. The horizontal plane that the ski-like elements are disposed in is preferably higher than the spring line (104) of the pipe 102. In this manner, fill material is "pre-leveled" to higher than the height of the spring line (104), so that the rams 142 and 144 can compact the fill material vertically to the spring line (104) of the pipe 102.

I claim:

1. A soil compactor for compacting soil under the haunches of and up to the spring line of a pipe in a trench, comprising:

an elongate frame;

first wheels for supporting the frame upon and moving the elongate frame along a pipe;

a first pair of rams extending from the elongate frame so as to be located near the bottom half of the pipe, for compacting the soil under the haunch of the pipe by tamping the soil at an angle from either side of the pipe towards the centerline of the pipe; and a second pair of rams extending from the elongate frame so as to located above the spring line of the pipe for tamping the soil in a downward direction on either side of the pipe.

2. A soil compactor, according to claim 1, further comprising:

a first shaping plate extending from the elongate frame forward of the first pair of rams.

3. A soil compactor, according to claim 2, further comprising:

a second shaping plate extending from the elongate frame forward of the second pair of rams.

* * * * *